US012654214B2

(12) United States Patent
McGrath

(10) Patent No.: US 12,654,214 B2
(45) **Date of Patent: *Jun. 16, 2026**

(54) SIDE RAIL REPAIR TOOL

(71) Applicant: Joseph McGrath, New Port Richey, FL (US)

(72) Inventor: Joseph McGrath, New Port Richey, FL (US)

( * ) Notice: Subject to any disclaimer, the term of this patent is extended or adjusted under 35 U.S.C. 154(b) by 17 days.

This patent is subject to a terminal disclaimer.

(21) Appl. No.: 18/609,461

(22) Filed: Mar. 19, 2024

(65) Prior Publication Data

US 2024/0216974 A1 Jul. 4, 2024

Related U.S. Application Data

(63) Continuation of application No. 17/865,988, filed on Jul. 15, 2022, now Pat. No. 11,958,094.

(60) Provisional application No. 63/225,609, filed on Jul. 26, 2021.

(51) Int. Cl.
*B21D 3/00* (2006.01)

(52) U.S. Cl.
CPC ..... *B21D 3/00* (2013.01)

(58) Field of Classification Search
CPC ... B21D 1/06; B21D 1/12; B21D 1/14; B21D 3/00; B21D 3/005; B21D 3/14; B21D 3/16
See application file for complete search history.

(56) References Cited

U.S. PATENT DOCUMENTS

| | | | | | |
|---|---|---|---|---|---|
| 2,616,317 | A * | 11/1952 | Hakkerup | B21D 1/12 | 72/705 |
| 4,034,594 | A * | 7/1977 | Morgan | B21D 1/06 | 81/463 |
| 4,429,562 | A * | 2/1984 | Hultquist | B21D 1/06 | D8/51 |
| 4,454,792 | A * | 6/1984 | Burris | B25B 27/02 | 294/90 |
| 4,751,840 | A * | 6/1988 | Windsor, Jr. | B21F 1/002 | 81/177.85 |
| 5,379,986 | A * | 1/1995 | Perez | B25D 1/16 | 254/19 |
| 9,597,720 | B2 * | 3/2017 | Wafer | B21D 3/16 | |
| 2020/0376673 | A1 * | 12/2020 | Tasaka | B25J 9/1694 | |

* cited by examiner

*Primary Examiner* — Teresa M Ekiert
(74) *Attorney, Agent, or Firm* — Ice Miller LLP

(57) ABSTRACT

A tool for repair and maintenance of a rail extending about the perimeter of a bed, the rail separated from the bed by a predetermined distance. The tool comprises a shaft with first and second sides. The first side has a curved surface, and the shaft has a cross-section normal to the curved surface with a maximum width that is less than the predetermined distance. A flange extends from the second side, the combined shaft and flange having a cross-section normal to the curved surface with a maximum width that is at least the predetermined distance.

13 Claims, 1 Drawing Sheet

SIDE RAIL REPAIR TOOL

This application is a continuation of prior application Ser. No. 17/865,988, filed Jul. 15, 2022, which claims the benefit of U.S. Provisional Application No. 63/225,609, filed on Jul. 26, 2021, which are hereby incorporated by reference herein in their entirety.

FIELD OF THE DISCLOSURE

The present disclosure relates generally to the field of hand tools, and specifically to a tool for maintaining or repairing a side rail, such as the rub rail of a truck or trailer bed.

BACKGROUND OF THE DISCLOSURE

Protective side rails are commonly used in a wide range of structures and devices. During use, the rails can become damaged, such that they are no longer effective. For example, flatbed trucks or trailers have a body with an open bed that can accommodate unusually shaped loads and that allows for rapid loading. Side rails or rub rails are positioned around the perimeter of the vehicle bed, to absorb impacts and protect the truck or trailer from damage. The rub rails are spaced apart from the vehicle bed by spacers (e.g., pocket stakes and/or pipe spools), that form an inboard space between the rub rail and vehicle bed. The separation between the rub rail and vehicle bed (i.e. minimum width of the inboard space) is a predetermined distance based on the size of the spacers.

Rub rails play an important role in securing cargo by serving as an anchor point for tie downs, such as a straps, webbing, or chains that loop over or surround the cargo. The tie downs are typically hooked to the rub rail and have a winch, ratchet or similar mechanism to tension the tie down and prevent movement of the load. The Cargo Securement Rules of the Federal Motor Carrier Safety Administration ("FMCSA") requires that tie downs are attached and secured in a manner that prevents the tie down from loosening, unfastening, opening, or releasing while the vehicle is in transit. The rule is intended to ensure that cargo is not damaged or shifted during transit, and to prevent fatalities and injuries resulting from unsecured cargo along the roadway. To ensure the cargo securement system is up to standard, the FMCSA requires that the tie downs and other components are located inboard of the rub rails whenever practicable (i.e. positioned in the inboard space between the rub rail and vehicle bed). Tie downs are commonly secured to the rub rail by a flat hook that is configured to fit within the inboard space, consistent with FMCSA rules.

Rub rails frequently experience accidental impacts from forklifts and other equipment during loading operations, which can cause the rub rail to become dented or bent inward toward the vehicle bed. In some cases, the damage to the rub rail reduces the inboard space such that the tie down hook can no longer be positioned in the inboard space to properly secure the tie down. Currently, there are few options for the vehicle operator to repair and straighten the rub rail after bending. The rub rail may be mended by replacing the bent section of the rub rail. This method involves considerable time and expense, may require welding, and cannot be conveniently performed by the vehicle operator. Alternatively, the rub rail may be manually bent back into place using a pry bar or similar tool. This method requires a significant effort to force the steel rub rail back into its original configuration and restore the separation between the rail and vehicle bed. Furthermore, the operator may have to stand on the top, the bottom, or to the side of the flat bed, which may be unsafe if it becomes necessary to conduct repairs at the side of the road. Consequently, operators often forgo repairing the rub rail and improperly secure cargo by hooking the tie down on the outside (outboard) of the rub rail, which is the opposite of the inboard recommendation from the FMCSA. As a result, the tie downs may become loose and inadvertently disengage from the rub rail during transit. Therefore, it would be desirable to provide a tool that permits the safe, convenient manual repair and maintenance of a protective rail.

SUMMARY OF THE DISCLOSURE

A tool is disclosed for repair of a rail extending about the perimeter of a bed. The rail separated from the bed by a predetermined distance. In one embodiment, the tool comprises a shaft having first and second sides, the first side having a curved surface, and the shaft having a cross-section normal to the curved surface with a width that is less than the predetermined distance. A flange is coupled to and extends from the second side of the shaft, the combined shaft and flange having a cross-section normal to the curved surface with a width that is at least the predetermined distance. In one embodiment, the tool further comprises a lock pin removably coupled to the shaft, the lock pin having a length that is greater than the predetermined distance. In one embodiment, the vehicle rail has a height, and the shaft has an opening that is sized and shaped to receive the lock pin, wherein the opening is separated from the stop by a distance that is at least the height of the rail.

In another embodiment, a tool for repair of a rail comprises a cylindrical shaft having a diameter that is less than the predetermined distance. A flange is coupled to and extends from the shaft, the combined shaft and flange having a cross-section perpendicular to the longitudinal axis of the shaft with a width that is at least the predetermined distance. A stop is coupled to the shaft, the stop having a width that is greater than the predetermined distance. The tool further comprises a separately formed handle for rotating the tool about the longitudinal axis of the shaft. A housing is coupled to the shaft, the housing having a channel sized and shaped to receive the handle.

Additional features, advantages, and embodiments of the disclosure may be set forth or apparent from consideration of the detailed description and drawings. Moreover, it is to be understood that the foregoing summary of the disclosure and the following detailed description and drawings provide non-limiting examples that are intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced.

DETAILED DESCRIPTION OF THE DISCLOSURE

Figure 1:
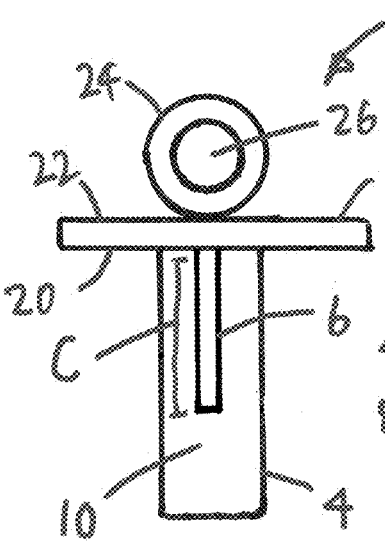
FIG. 1 shows a front view, of a non-limiting embodiment of a tool according to the principles of the disclosure.

The disclosure and its various features and advantageous details are explained more fully with reference to the non-limiting embodiments and examples that are described or illustrated in the accompanying drawings and detailed in the following description. It should be noted that features illustrated in the drawings are not necessarily drawn to scale, and features of one embodiment can be employed with other embodiments as those skilled in the art would recognize, even if not explicitly stated. Descriptions of well-known components and processing techniques may be omitted so as to not unnecessarily obscure the embodiments of the disclosure. The examples are intended merely to facilitate an understanding of ways in which the disclosure can be practiced and to further enable those skilled in the art to practice the embodiments of the disclosure. Accordingly, the examples and embodiments should not be construed as limiting the scope of the disclosure. Moreover, it is noted that like reference numerals represent similar parts throughout the several views of the drawings.

Figure 5:
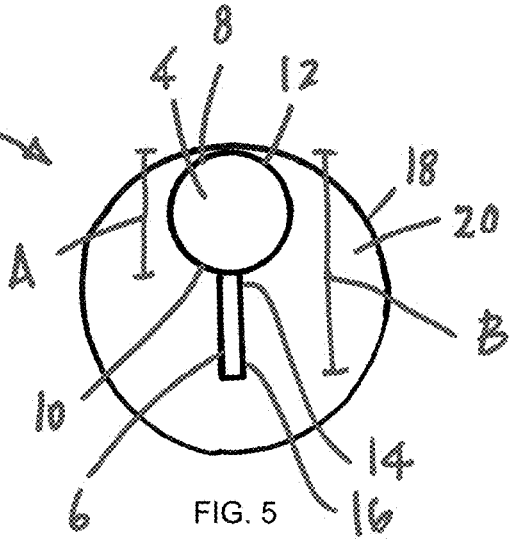
FIG. 5 shows a bottom view, of the tool of FIG. 1.

Referring to FIGS. 1-5, an embodiment of a tool for maintaining and repairing a protective rail such as a rub rail is shown. The tool 2 comprises a shaft 4 and a flange 6. Shaft 4 has a first side 8 and second side 10. First side 8 has a curved surface 12 that extends parallel to the longitudinal axis of shaft 4. In one embodiment, curved surface 12 comprises a cylindrical segment. Shaft 4 has a cross-section perpendicular to the longitudinal axis that is sized and shaped to fit within the inboard space between the rub rail and vehicle bed. In the embodiment of FIG. 5, shaft 4 has a cross-section normal to curved surface 12 with a maximum width A that is less than the predetermined distance between the rub rail and vehicle bed. In a preferred embodiment, shaft 4 is a cylinder with a diameter that is less than the predetermined distance between the rub rail and vehicle bed.

Flange 6 has opposite first and second ends 14 and 16. End 14 is positioned adjacent to second side 10 of shaft 4, and end 16 extends away from the shaft. The combined shaft and flange are sized and shaped to fit within the inboard space between the rub rail and vehicle bed. In one embodiment, flange 6 is coupled to second side 10 of shaft 4, and is positioned opposite curved surface 12. The combined shaft and flange has a maximum width that is greater than the predetermined distance between the rub rail and vehicle bed. In a preferred embodiment, flange 6 is generally blade-shaped and extends from shaft 4 normal to curved surface 12. The combined shaft 4 and flange 6 has a cross-section normal to curved surface 12 (perpendicular to the longitudinal axis of the shaft) with a width between curved surface 12 and end 16 (width B) that is greater than the predetermined distance between the rub rail and vehicle bed. In a further embodiment, flange 6 extends longitudinally along shaft 4 by a length C (FIG. 1) that is at least about the height of the rub rail.

In operation, tool 2 is positioned in the inboard space between the rub rail and vehicle bed at a region where the rub rail is bent or dented inward. The longitudinal axis of shaft 4 extends transverse to the length of the rub rail, and curved surface 12 is positioned adjacent to the vehicle bed. Shaft 4 serves as a pivot for rotation of tool 2 about the longitudinal axis of the shaft, with curved surface 12 forming a rocker bearing surface against the vehicle bed to facilitate rotation of the tool. The rotation of tool 2 causes end 16 of flange 6 to rotate and engage the bent portion of the rub rail. The continued rotation of tool 2 causes flange 6 to force the bent portion of the rub rail outward to restore the predetermined distance between the rail and vehicle bed. In some cases, it may be necessary to force the bent portion of the rub rail outward beyond its original position to compensate for any shape memory of the rub rail. Therefore, it is preferable that the combined shaft 4 and flange 6 have a maximum width that is greater than the original predetermined distance between the rub rail and vehicle bed, as described above. Those of skill in the art will appreciate that it is also possible to operate tool 2 by rotation in the opposite direction, with curved surface 12 bearing against the rub rail and end 16 of flange 6 engaging the vehicle bed.

Figure 2:
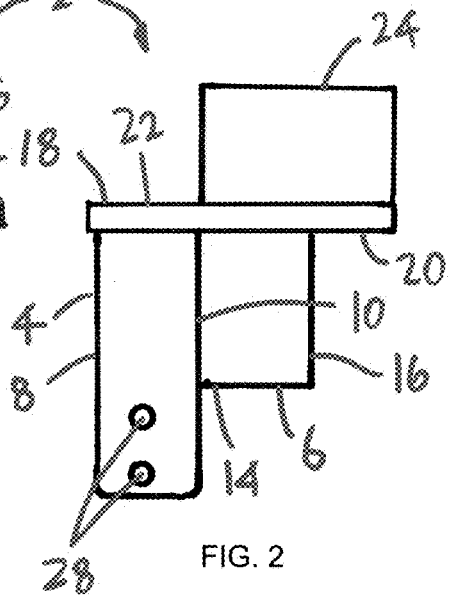
FIG. 2 shows a side view, of the tool of FIG. 1.
Figure 3:
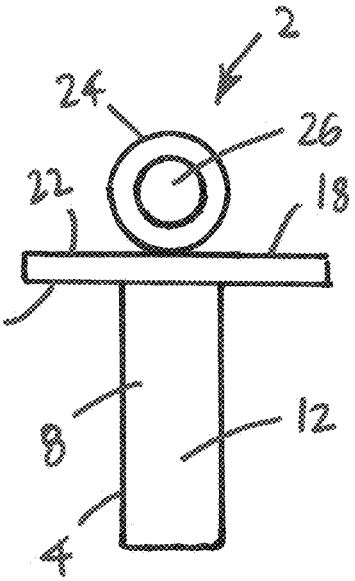
FIG. 3 shows a rear view, of the tool of FIG. 1.
Figure 4:
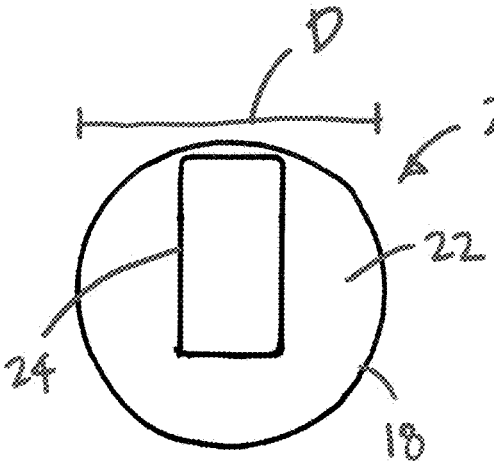
FIG. 4 shows a top view, of the tool of FIG. 1.

In one embodiment, tool 2 includes a stop for positioning the tool in the inboard space. The stop may be coupled to shaft 4, and the stop, or the combined stop and shaft, has a width D (FIG. 4) that is greater than the predetermined distance between the rub rail and vehicle bed. In a preferred embodiment, stop 18 is disk-shaped with a diameter that is greater than the predetermined distance between the rub rail and vehicle bed. Disk-shaped stop 18 has opposite sides 20 and 22, with shaft 4 coupled to side 20. In a preferred embodiment, both shaft 4 and flange 6 are coupled to side 20 of stop 18, as best shown in FIG. 2.

When tool 2 is positioned in the inboard space between the rub rail and the vehicle bed, stop 18 extends across the space between the rub rail and vehicle bed to prevent the tool from passing through the inboard space. Side 20 of stop 18 rests on the rub rail and vehicle bed, and positions flange 6 to engage the rail when shaft 4 is rotated as described above.

In another embodiment, tool 2 includes a handle to facilitate manual rotation of the tool. The handle may be formed integrally with tool 2, or may be formed separately and removably coupled to the tool. In one embodiment, the handle is a rod or other member that provides a grip for an operator to exert torque and rotate tool 2. In an alternative embodiment, tool 2 may be configured to use a readily available, conventional vehicle tool or accessory as a handle, such as a winch bar. For example, flatbed trucks and trailers are commonly equipped with one or more winches for tightening tie down straps, as is known in the art. The winch is operated by a winch bar, which is a long, generally cylindrical rod about three feet in length. One end of the winch bar is inserted into a corresponding opening in the winch spool, and the operator uses the winch bar as a lever to rotate (wind) the winch spool and tighten the tie down strap.

Tool 2 may include a housing 24 coupled to shaft 4 for removably receiving a separately formed handle. In the embodiment of FIGS. 1-4, housing 24 is positioned on side 22 of stop 18, such that it projects above the inboard space when shaft 4 is positioned in the inboard space. Housing 24 has an opening or channel 26 that is sized and shaped to receive a rod or other member that serves as a handle (not shown). In one embodiment, housing 24 is tube with a channel 26 that is sized and shaped to receive the end of a conventional winch bar.

In one embodiment, housing 24 is positioned on the longitudinal axis of shaft 4, such that the rotation of the housing is directly transferred to the rotation of the shaft. In a preferred embodiment, the position of housing 24 is displaced from the longitudinal axis of shaft 4, as best shown in FIG. 2. Positioning housing 24 off-axis of shaft 4 is believed to increase the torque that may be applied when the handle is used to rotate tool 2. In a further preferred embodiment, when the handle is received in housing 24, the handle extends over and intersects the longitudinal axis of shaft 4.

Tool 2 may include a lock that releasably secures the tool in the inboard space between the rub rail and vehicle bed. During operation, a substantial amount of force must be applied to rotate tool 2 and straighten the damaged rub rail. The inadvertent release of tool 2 from the inboard space can be dangerous to the operator and may cause injury. Therefore, it is desirable to have a means of securing tool 2 within the inboard space.

In one embodiment, the lock comprises a lock pin removably coupled to shaft 4, the lock pin having a length that is greater than the predetermined distance between the rub rail and vehicle bed. Suitable removable lock pins include a conventional cotterless hitch pin (detent pin), hairpin cotter, combination of a ring pin and hairpin cotter, or other removable pin known in the art. Shaft 4 has opposite first and second ends, the first end coupled to stop 18 and the second end having one or more openings 28 (FIG. 2) that are sized and shaped to receive the lock pin (not shown). Shaft 4 has a length greater than the height of the rub rail, such that the shaft extends below the rail. Stop 18 and opening 28 are separated by a distance that is at least the height of the rub rail.

In operation, shaft 4 is inserted into the inboard space with stop 18 resting on the top of the rub rail. Shaft 4 projects through the inboard space with opening 28 positioned below the bottom of the rub rail. The lock pin is then removably inserted into opening 28 to releasably secure tool 2 in the inboard space. Because the lock pin has a length greater than the predetermined distance between the rub rail and vehicle bed, tool 2 cannot be withdrawn from the inboard space until the lock pin is removed. In a preferred embodiment, shaft 4 may have multiple openings 28 to accommodate rub rails of different heights.

In one embodiment, shaft 4 is a cylinder having a length of about 3.5 inches and a diameter of about 1.5 inches. Flange 6 is blade shaped with a thickness of about 0.25 to 0.375 inches, a length C of about 2 to 2.5 inches, and a width of about 1.25 to 2.5 inches. In a preferred embodiment, flange 6 is coupled to a first end of shaft 4, and has a thickness of about 0.25 inches, a length C of about 2 inches, and a width of about 1.25 inches. Stop 18 is disk-shaped with a diameter of about 4 inches and a thickness of about 0.25 inches. The first end of shaft 4 is positioned at the circumference or edge of side 20 of stop 18, with flange 6 extending diametrically across side 20. The second end of shaft 4 is opposite the first end and has one or more openings 28 positioned below flange 6 for receiving a removable lock pin. Openings 28 have a diameter of about 0.25 inches. Housing 24 is tube-shaped with an outer diameter of about 1.5 inches and an inner opening or channel 26 with a diameter of about 0.75 to 1 inches, and a length of about 1.5 to 2.5 inches. In a preferred embodiment, housing 24 has a length of about 2.5 inches and channel 26 has a diameter of about 0.75 inches. Housing 24 is positioned at the edge of side 22 of stop 18 opposite to shaft 4, and extends diametrically across side 22 toward the shaft. Those of skill in the art will appreciate that the dimensions and configurations of shaft 4, flange 6, stop 18, and housing 24 may vary based on the dimensions and configurations of the rub rail, inboard space, and handle.

Tool 2 may be made of various materials or combinations of materials that known in the art, and is preferably made of harden steel. Shaft 4, a flange 6, a stop 18, and a housing 24 may be made separately from readily available metal stock (e.g., plates, sheets, rods, tubing), and coupled together by welding.

The terms "a," "an," and "the," as used in this disclosure, means "one or more," unless expressly specified otherwise.

The terms "including," "comprising," and variations thereof, as used in this disclosure, mean "including, but not limited to," unless expressly specified otherwise. Although process steps, method steps, or the like, may be described in a sequential order, such processes and methods can be configured to work in alternate orders. In other words, any sequence or order of steps that may be described does not necessarily indicate a requirement that the steps be performed in that order. The steps of the processes or methods described herein can be performed in any order practical. Further, some steps can be performed simultaneously.

When a single structure or article is described herein, it will be readily apparent that more than one device or article may be used in place of a single device or article. Similarly, where more than one device or article is described herein, it will be readily apparent that a single structure or article may be used in place of the more than one structure or article. The functionality or the features of a structure or article may be alternatively embodied by one or more other structures or articles that are not explicitly described as having such functionality or feature.

While the disclosure has been described in terms of exemplary embodiments, those skilled in the art will recognize that the disclosure can be practiced with modifications in the spirit and scope of the instant disclosure. These examples given above are merely illustrative and are not meant to be an exhaustive list of all possible designs, embodiments, applications or modifications of the disclosure.

What is claimed is:

1. A tool for repair of a rail extending about the perimeter of a bed, the tool comprising:

a shaft having a longitudinal axis, first and second shaft ends, and first and second shaft sides, the first shaft side having a curved surface;

a blade-shaped flange coupled to and extending from the second shaft side, the flange having a length, width, and thickness, the flange length extending longitudinally on the first shaft side and extending from the shaft normal to the curved surface;

a stop having first and second stop sides, the first shaft end coupled to the first stop side; and a housing coupled to the second stop side, the housing comprising a channel;

wherein the first side curved surface is a bearing surface for rotation of the tool against the bed about the longitudinal axis of the shaft, to rotate the flange to engage the rail.

2. The tool of claim 1, wherein the shaft is cylindrical.

3. The tool of claim 2, wherein the shaft has a diameter of about 1.5 inches and the flange has a width extending from the shaft of about 1.25 inches.

4. The tool of claim 1, further comprising a lock pin removably coupled to the shaft.

5. The tool of claim 4, wherein the shaft has an opening positioned at the second shaft end, the opening sized and shaped to receive the lock pin.

6. The tool of claim 4, wherein the lock pin is a cotterless hitch pin.

7. The tool of claim 4, wherein the lock pin is a hairpin cotter.

8. The tool of claim 1, further comprising a handle that is separately formed, and wherein the channel is sized and shaped to receive the handle.

9. The tool of claim 8, wherein the handle is received in the channel and intersects the longitudinal axis of the shaft.

10. The tool of claim 1, wherein the flange width extends diametrically across the first stop side.

11. The tool of claim 1, wherein the flange is coupled to the first stop side.

12. The tool of claim 1, wherein the channel extends diametrically across the second stop side.

13. The tool of claim 1, wherein the housing is positioned on the longitudinal axis of the shaft.

* * * * *